US007381300B2

(12) United States Patent
Skaggs et al.

(10) Patent No.: US 7,381,300 B2
(45) Date of Patent: Jun. 3, 2008

(54) PROCESS FOR MANUFACTURING PAPER AND PAPERBOARD PRODUCTS

(75) Inventors: Benny J Skaggs, Springboro, OH (US); Chris Wilson, Middletown, OH (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/590,317

(22) Filed: Oct. 31, 2006

(65) Prior Publication Data

US 2008/0098931 A1 May 1, 2008

(51) Int. Cl.

| | |
|---|---|
| ***D21H 19/12*** | (2006.01) |
| ***D21H 19/42*** | (2006.01) |
| ***D21H 19/54*** | (2006.01) |
| *C09D 103/02* | (2006.01) |
| *C09D 103/08* | (2006.01) |
| *C09D 103/10* | (2006.01) |

(52) U.S. Cl. ..... 162/175; 162/162; 106/206.1; 106/208.1; 106/208.2; 106/208.4; 106/209.1; 106/213.1

(58) Field of Classification Search ..... 106/206.1, 106/209.1, 208.1, 208.2, 208.4, 213.1; 162/162, 162/175

See application file for complete search history.

(56) References Cited

U.S. PATENT DOCUMENTS

| | | | | |
|---|---|---|---|---|
| 4,040,900 | A * | 8/1977 | Mazzarella et al. | 162/158 |
| 4,264,325 | A * | 4/1981 | Meyer et al. | 8/648 |
| 5,873,913 | A * | 2/1999 | Cowman et al. | 8/648 |
| 6,030,443 | A * | 2/2000 | Bock et al. | 106/217.5 |
| 6,426,382 | B1 * | 7/2002 | Farrar et al. | 524/815 |
| 6,723,846 | B1 * | 4/2004 | Metzger et al. | 544/193.2 |
| 2004/0016528 | A1 * | 1/2004 | Varnell | 162/164.6 |
| 2006/0005935 | A1 * | 1/2006 | Harris et al. | 162/183 |
| 2007/0125267 | A1 * | 6/2007 | Song et al. | 106/214.1 |

* cited by examiner

*Primary Examiner*—David M Brunsman
(74) *Attorney, Agent, or Firm*—Matthew M. Eslami

(57) ABSTRACT

The present invention relates to a process for applying optical brightening agent (OBA) to a sheet of paper or paperboard substrate. The process comprises applying the composition comprising a cooked starch and a powdered optical brightener to at least one surface of a paper or paperboard substrate at the size press in a paper or paperboard manufacturing process to form a sized paper or paperboard substrate; and drying the sized paper or paperboard substrate to form a dried sized paper or paperboard substrate.

13 Claims, 4 Drawing Sheets

PROCESS FOR MANUFACTURING PAPER AND PAPERBOARD PRODUCTS

FIELD OF THE INVENTION

This invention relates to an improved method for manufacturing paper and paperboard products and paper and paperboard products manufactured by the process. More particularly, this invention relates to method for manufacturing paper and paperboard products having.

BACKGROUND OF THE INVENTION

The brightness and whiteness of paper or paperboard can be improved by, among other ways, treating the surface of a paper or paperboard web with an optical whitener or optical brightening agent (OBA). The OBA works by absorbing UV light and re-emitting it at visible light wavelengths, measured in a specified reflective range.

SUMMARY OF THE INVENTION

One aspect of the present invention relates to a method of manufacturing paper and paperboard products comprising:

forming a composition comprising water, uncooked starch and powdered optical brightener;

cooking the composition to form a cooked composition comprising cooked or hydrated starch and powdered optical brightener;

applying the cooked composition to at least one surface of a paper or paperboard substrate at the size press in a paper or paperboard manufacturing process to form a sized paper or paperboard substrate; and drying the sized paper or paperboard substrate to form a dried sized paper or paperboard substrate.

Another aspect of the present invention relates to a method of manufacturing sized paper and paperboard products comprising:

forming a sizing composition comprising water, cooked starch and powdered optical brightener;

applying the sizing composition to at least one surface of a paper or paperboard substrate at the size press in a paper or paperboard manufacturing process to form a sized paper or paperboard substrate; and drying the sized paper or paperboard substrate to form a dried sized paper or paperboard substrate.

Still another aspect of the present invention relates to a dried sized paper or paperboard substrate formed by the process of this invention. The process of this invention and the dried sized paper or paperboard substrate formed by the process of this invention exhibit one or more beneficial properties. For example, the dried sized paper or paperboard substrate formed by the process of this invention exhibit higher brightness ceilings as compared to dried sized paper or paperboard substrate formed by conventional processes in which a liquid optical brightener is added to cooked starch to form the size press composition.

Yet another aspect of the present invention relates to the cooked composition comprising cooked starch and powdered optical brightener.

BRIEF DESCRIPTION OF THE DRAWINGS

A full understanding of the invention can be gained from the following description of the preferred embodiments when read in conjunction with the accompanying drawings in which.

DETAILED DESCRIPTION OF THE INVENTION

Figure 1:
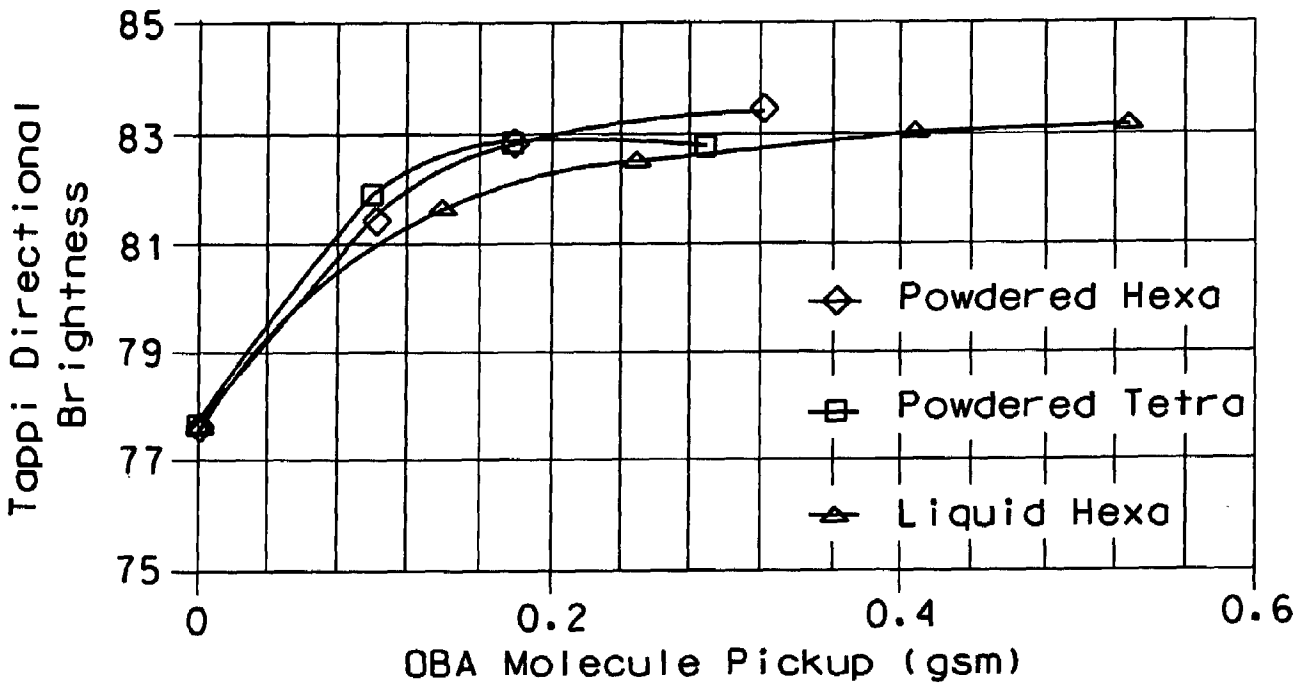
FIG. 1 is a graph of Tappi Directional Brightness versus optical brightener pickup in grams based on Example 1.
Figure 2:
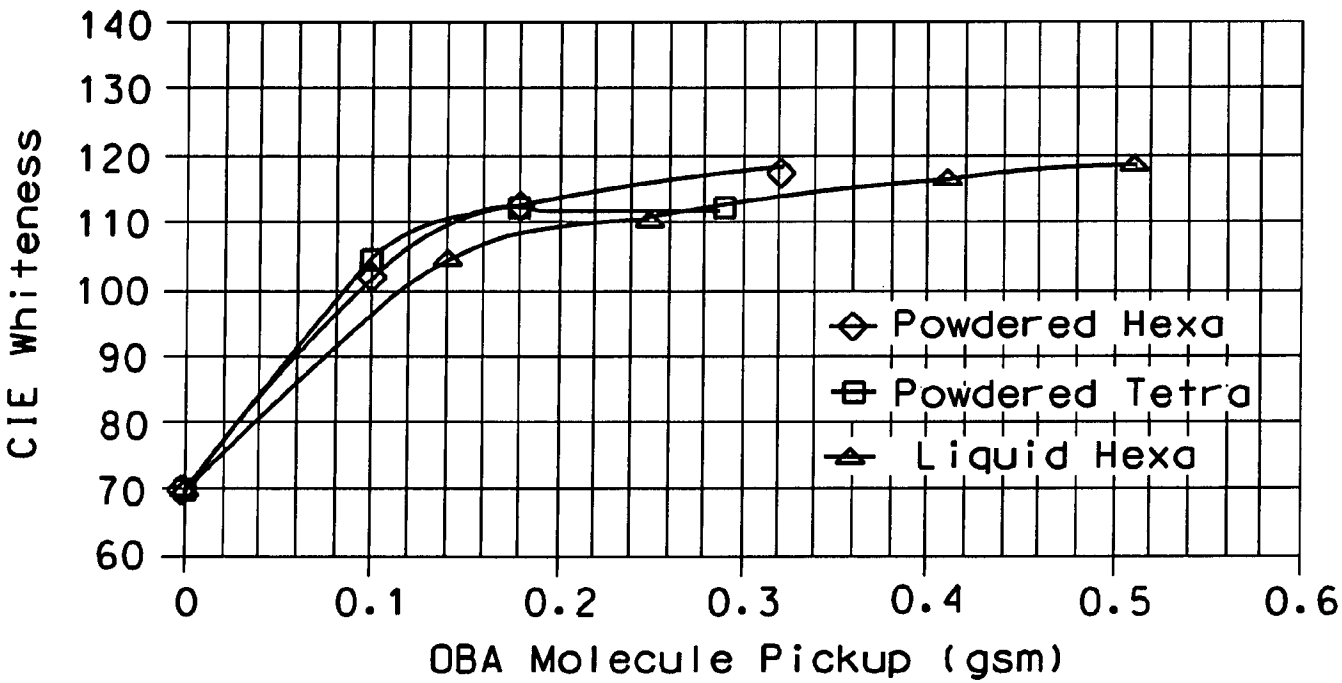
FIG. 2 is a graph of CIE Whiteness versus optical brightener pickup in grams based on Example 1.
Figure 3:
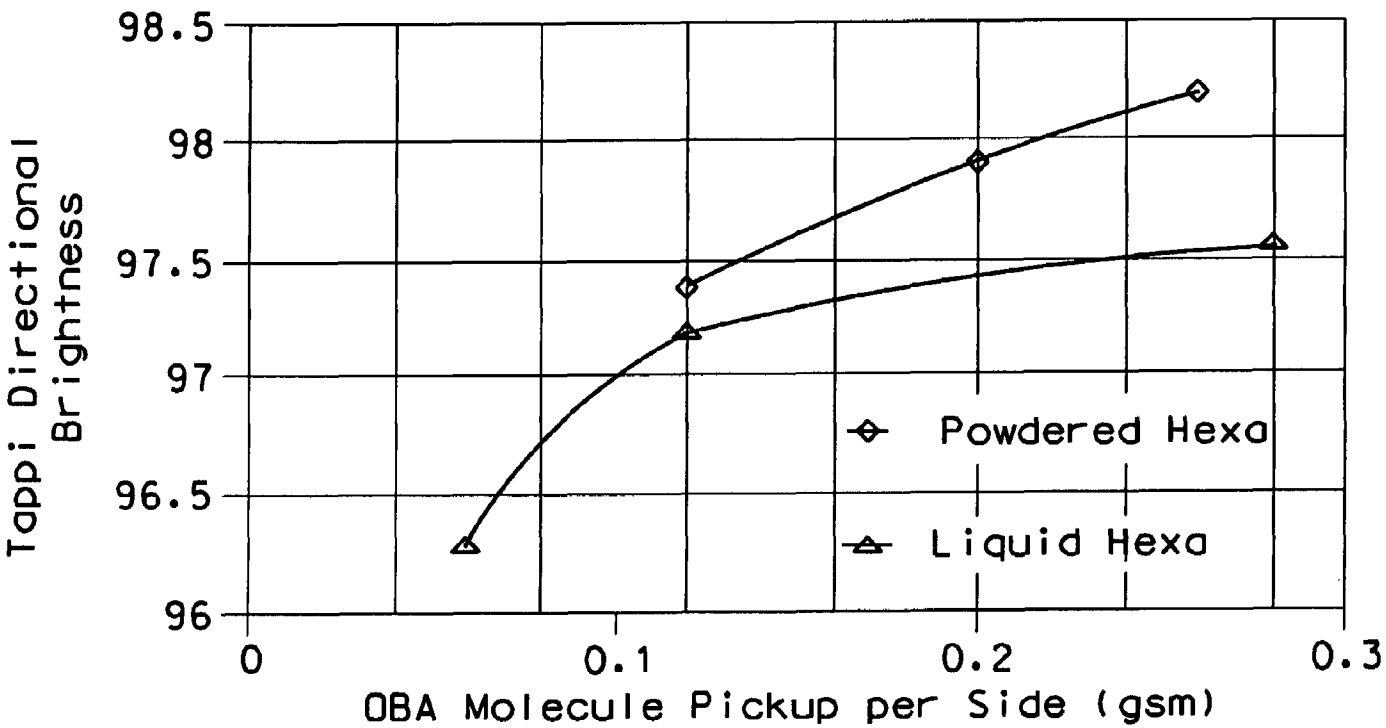
FIG. 3 is a graph of Tappi Directional Brightness versus optical brightener pickup in grams based on Example 2.
Figure 4:
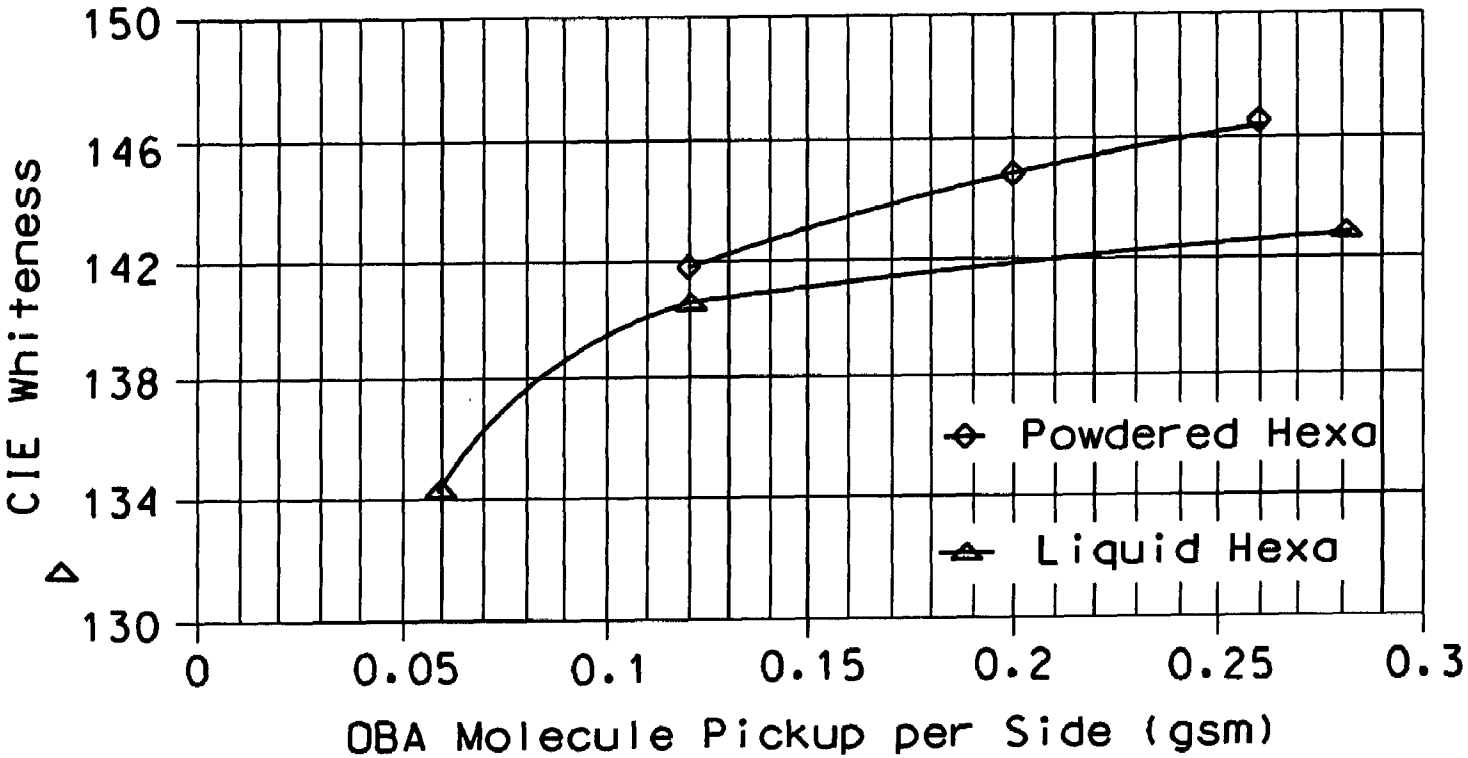
FIG. 4 is a graph of CIE Whiteness versus optical brightener pickup in grams based on Example 2.

While this invention is susceptible of embodiment in many different forms, there is shown and described in drawing, figures, and examples and will herein be described in detail preferred embodiments of the invention with the understanding that the present disclosure is to be considered as an exemplification of the principles of the invention and is not intended to limit the broad aspect of the invention to the embodiments illustrated.

In the processes of this invention, a sizing composition comprising a cooked starch and powdered optical brightener is applied to at least one surface of a paper or paper board substrate. The viscosity of the sizing composition can vary widely. For example, the viscosity can be a low as about 20 cps and as high as about 350 cps or higher. The viscosity is preferably from about 100 cps to about 300 cps, more preferably from about 150 cps to about 250 cps and most is preferably from about 175 cps to about 225 cps.

The percent solids in the sizing composition can vary widely. For example, the percent solids can be a low as about 4% and as high as about 22% or higher based on the total weight of the sizing composition. The percent solids is preferably from about 8% to about 21%, more preferably from about 10% to about 19% and most is preferably from about 13% to about 18%.

The starch may be of any type, including but not limited to oxidized, ethylated, cationic and pearl, and is preferably used in aqueous solution. Illustrative of useful starches for the practice of this preferred embodiment of the invention are naturally occurring carbohydrates synthesized in corn, tapioca, potato and other plants by polymerization of dextrose units. All such starches and modified forms thereof such as starch acetates, starch esters, starch ethers, starch phosphates, starch xanthates, anionic starches, cationic starches and the like which can be derived by reacting the starch with a suitable chemical or enzymatic reagent can be used in the practice of this invention.

Useful starches may be prepared by known techniques or obtained from commercial sources. For example, the suitable starches include PG-280 from Penford Products, SLS-280 from St. Lawrence Starch, the cationic starch CatoSize 270 from National Starch and the hydroxypropyl No. 02382 from Poly Sciences, Inc.

Preferred starches for use in the practice of this invention are modified starches. More preferred starches are cationic modified or non-ionic starches such as CatoSize 270 and KoFilm 280 (all from National Starch) and chemically modified starches such as PG-280 ethylated starches and AP Pearl starches. More preferred starches for use in the practice of this invention are cationic starches and chemically modified starches.

The amount of starch in the size press composition can be varied widely and any amount can be used. For example, the amount of starch can be as high as about 100% or higher and as low as about 50% or higher based on the total weight of the composition. The amount of starch is preferably from about 60% to about 90%, more preferably from about 65% to about 85% and most preferably from about 70% to about 80%, based on the total weight of the composition.

Powdered optical brightening agents ("OBAs") used in the practice of the process of this invention may vary widely and any conventional OBA used or which can be used to brighten mechanical or Kraft pulp can be used in the conduct of the process of this invention. Optical brighteners are dye-like fluorescent compounds are substances that absorb light in the invisible ultraviolet region of the spectrum and reemit it in the visible portion of the spectrum, particularly in the blue to blue violet wavelengths. This provides added brightness and can offset the natural yellow cast of a substrate such as paper. Optical brighteners used in the present invention may vary widely and any suitable optical brightener may be used. An overview of such brighteners is to be found, for example, in Ullmann's Encyclopedia of Industrial Chemistry, Sixth Edition, 2000 Electronic Release, OPTICAL BRIGHTENERS—Chemistry of Technical Products which is hereby incorporated, in its entirety, herein by reference. Other useful optical brighteners are described in U.S. Pat. Nos. 5,902,454; 6,723,846; 6,890,454; 5,482,514; 6,893,473; 6,723,846; 6,890,454; 6,426,382; 4,169,810; and 5,902,454 and references cited therein which are all incorporated by reference. Still other useful optical brighteners are described in; and U.S. Pat. Application Publication Nos. US 2004/014910 and US 2003/0013628; and WO 96/00221 and references cited therein which are all incorporated by reference. Illustrative of useful optical brighteners are 4,4'-bis-(triazinylamino)-stilbene-2,2'-disulfonic acids, 4,4'-bis-(triazol-2-yl)stilbene-2,2'-disulfonic acids, 4,4'-dibenzofuranyl-biphenyls, 4,4'-(diphenyl)-stilbenes, 4,4'-distyryl-biphenyls, 4-phenyl-4'-benzoxazolyl-stilbenes, stilbenzyl-naphthotriazoles, 4-styryl-stilbenes, bis-(benzoxazol-2-yl) derivatives, bis-(benzimidazol-2-yl) derivatives, coumarins, pyrazolines, naphthalimides, triazinyl-pyrenes, 2-styryl-benzoxazole or -naphthoxazoles, benzimidazole-benzofurans or oxanilides.

Most commercially available optical brightening agents are based on stilbene, coumarin and pyrazoline chemistries and these are preferred for use in the practice of this invention. More preferred optical brighteners for use in the practice of this invention are optical brighteners typically used in the paper industry based on stilbene chemistry such as 1,3,5-triazinyl derivatives of 4,4'-diaminostilbene-2,2'-disulfonic acid and salts thereof, which may carry additional sulfo groups, as for example at the 2, 4 and/or 6 positions. Most preferred are the commercially available stilbene derivatives as for example those commercially available from Ciba Geigy under the tradename "Tinopal", from Clariant under the tradename "Leucophor", from Lanxess under the tradename "Blankophor", from 3V under the tradename "Optiblanc" such as disulfonate, tetrasulfonate and hexasulfonate stilbene based optical brightening agents. Of these most preferred commercial optical brightening agents, the commercially available hexa sulfonate and tetra sulfonate stilbene based optical brightening agents are more preferred and the commercially available hexa sulfonate stilbene based optical brightening agents is most preferred.

The amount of optical brightener used in the practice of the process of this invention can vary widely and any amount sufficient to provide the desired degree of brightness can be used. In general, the lesser the amount of optical brightener employed the less the enhancement in TAPPI brightness of the final pulp product. Conversely, the greater the amount of optical brightener used the greater the enhancement in pulp brightness except that while we do not wish to be bound by any theory, it is believe that at some point the addition of more optical brightener will not have any further appreciable impact on pulp brightness and may even result in a decrease in pulp brightness. The amount of optical brightener used is usually at least about 0.5 wgt % based on tons of paper produced. Preferably the amount of optical brightener is from about 0.5 to about 2 wgt %, more preferably from about 0.75 to about 1.75 wgt % and most preferably from about 1 to about 1.5 wgt % on the aforementioned basis.

The amount of powdered OBA in the size press composition can be varied widely and any amount can be used. For example, the amount of OBA can be as high as about 50% based on the total weight of the composition. The amount of OBA is preferably as high as about 25% based on the total weight of the composition. More preferably, the amount of OBA in the aqueous solution is from about 2 to about 10%. Most preferably, the amount of OBA in the aqueous solution is from about 5 to about 10%. It was determined that 2% concentration of OBA is optimum for visual purposes. Subsequent trials modifying optical properties have used higher concentrations of applied chemical. This can be dependent or independent of machine speed. The OBA application weight is at least about 0.7 wt %. More preferably, the application weight of OBA at least about 0.9 wt %. Most preferably, the basis weight of OBA is at least about 1.1 wt %. The OBA is predominately at or near a surface of the paper or paperboard substrate. For example, the amount of OBA at the surface of the paper or paperboard substrate can greater than 90%.

The sizing composition may include other optional ingredients in addition to the starch and powdered optical brightener. Such optional components include dispersants, fluorescent dyes, surfactants, deforming agents, preservatives, pigments, binders, pH control agents, coating releasing agents, and the like.

The sizing composition can be formed by conventional processes of forming a sizing composition by adding powdered optical brightener to a starch sizing composition comprising water and cooked starch. These methods are well known in the art. See for example "Handbook for Pulp & Paper Technologists" G. A. Smook 1982 TAPPI and the references cited therein and will not be described in any detail.

The sizing composition can also form the sizing composition comprising water, uncooked starch and powdered optical brightener and cooking the composition to hydrate the starch to form the cooked composition comprising cooked starch and powdered optical brightener. This method is preferred because ease of application, ease of preparation, and uniformity of OBA distribution.

In this preferred method conventional starch cooking techniques can be used. Complete hydration of a starch molecule and dispersion of the powdered optical brightener in the size composition requires four things: water, temperature, time, and agitation. The amount of water needed depends on the type of starch and how it has been modified. For example, a starch may require cooking at 6% solids, while a highly modified coating starch may cook at 400% solids. Cooking solids are very critical to starch performance: If the solids level is too high, the performance of the starch will degrade. Shear is also important in order to completely explode and disperse the starch granules and powdered optical brightener. In atmospheric cooking, it is necessary to maintain good high shear throughout the cooking process. Most starch begins to gel between 140 and 160° F. Highly modified starch begins to gel at temperatures as low as 115° F. Some cross-linked starches require elevated jet cooker temperatures, for example, up to 195° F. or higher. Starch cooked at atmospheric pressure may require a 20 to 30-min cooking time, while cooking is instantaneous in jet or thermal/chemical cooking processes.

Enzyme conversion. The enzyme conversion process consists of making up slurry of water and starch at the desired total solids and adjusting pH to the recommended value. The slurry is agitated and heated at a programmed temperature rate rise until about 170° F. After holding there, usually for about 30 min, the temperature is increased as rapidly as possible at a programmed rate to about 195° F. This temperature is usually adequate to "kill" the enzyme in about 15 to 30 min. The material is then cooled to the desired temperature.

The most common methods of cooking are atmospheric or batch, enzyme, jet, and thermal/chemical. In both batch and continuous enzyme cooking, strict control of several key factors is preferred. These include the rate of rise in temperature, holding period, and viscosity. These factors require strict regulation in order to develop reproducible, uniform results.

Thermal conversion and jet cooking. Jet cooking is the preferred method for hydrating starch, and continuous cookers have been available for years. High-temperature, pressure, and high shear conditions are applied through the use of "excess" steam. This method provides considerably lower viscosity for a given starch compared to atmospheric cooking. Starch paste produced by jet cooking provides the following advantages: (1) a reduction in manpower, (2) automated cooking process, (3) uniform viscosity, and (4) complete hydration of the starch molecules.

Paper and paperboard substrates used in the practice of this invention can vary widely. Such paper and paperboard substrates and methods and apparatus for their manufacture are well known in the art. See for example "Handbook For Pulp & Paper Technologies", $2^{nd}$ Edition, G. A. Smook, Angus Wilde Publications (1992) and references cited therein, which are hereby incorporated, in their entirety, herein by reference. For example, the paper or paperboard web can be made from pulp fibers derived from hardwood trees, softwood trees, or alternatively, a combination of hardwood and softwood trees is prepared for use in a papermaking furnish by any known suitable digestion, refining, and bleaching operations, as for example, known mechanical, thermomechanical, chemical and semi chemical, pulping and other well known pulping processes. In certain embodiments, at least a portion of the pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention. Recycled pulp fibers are also suitable for use. In the preferred embodiment, the cellulosic fibers in the paper or related web include from about 0% to about 100% by weight dry basis softwood fibers and from about 100% to about 0% by weight dry basis hardwood fibers.

In the preferred embodiments of the invention, in addition to pulp fibers and the paper or paperboard may also include various optional ingredients known for use in paper making including optical brighteners such as those described above; dispersed expanded or expandable synthetic resinous particles having a generally spherical hydrocarbon liquid-containing center; starch; mineral fillers; inorganic salts such as sodium chloride; internal sizing agents; dyes; retention aids; dry strength resins; strengthening polymers and the like.

The density, basis weight and caliper of the paper or paperboard web of this invention may vary widely. For example, any conventional basis weights, densities and calipers may be employed depending on the paper-based product formed from the web.

The Tappi brightness of the paper or paperboard substrate can vary widely. The desired for example, the Tappi brightness of the paper or paperboard substrate may be as low as 75 and as high as 96. The Tappi brightness of the paper or paperboard substrate is preferably equal to or greater that 90, more preferably equal to or greater that about 95, and most preferably equal to or greater that about 92. In the embodiments of choice, the Tappi brightness of the paper or paperboard substrate is from about 90 to about 94. CIE Whiteness of the paper or paperboard substrate can vary widely. CIE Whiteness is preferably at least about 85, more preferably at least about 130 and most preferably from about 100 to about 125. CIE Whiteness is preferably at least about 110, more preferably at least about 120. Surprisingly, it has been discovered that in the preferred embodiments of the invention the difference in brightness ceiling of paper or paperboard made by the process of this invention as compared to conventional size press application of liquid optical brightener is greater the higher the Tappi brightness of the substrate. For this reason, higher substrate brightness is preferred. The desired TAPPI brightness of the paper or paperboard substrate can be obtained using conventional methods as for example by extra bleaching and/or by addition of optical brightener to the substrate.

Methods and apparatuses for treating a web of paper or paperboard with a sizing composition are well known in the paper and paperboard art. See for example "Handbook For Pulp & Paper Technologies", $2^{nd}$ Edition, G. A. Smook, Angus Wilde Publications (1992) and references cited therein. Any conventional size treatment method and apparatus can be used. Consequently, these methods and apparatuses will not be described herein in any great detail. By way of example, the size composition may be applied from a size press that can be any type of coating or spraying equipment, but most commonly is a puddle, gate roller or metered blade type of size press.

The paper or paperboard web is dried after treatment with the size composition. Methods and apparatuses for drying paper or paperboard webs treated with a sizing composition are well known in the paper and paperboard art. See for example G. A. Smook referenced above and references cited therein. Any conventional drying method and apparatus can be used. Consequently, these methods and apparatuses will not be described herein in any great detail. After drying, the paper may be subjected to one or more post drying steps as for example those described in G. A. Smook referenced above and references cited therein. For example, the paper or paperboard web may be coated and/or calendered to achieve the desired final caliper as discussed above to improve the smoothness and other properties of the web. The calendering may be accomplished by steel-steel calendaring at nip pressures sufficient to provide a desired caliper. It will be appreciated that the ultimate caliper of the paper ply will be largely determined by the selection of the nip pressure In the preferred embodiments, the paper and paperboard exhibits a higher Tappi brightness ceiling as compared to the paper and paperboard in which liquid optical brightener is added to cooked starch or is cooked with starch and the resulting size composition is applied to the substrate at the size press. The increase in brightness ceiling is preferably at least about 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29% and 30% greater than the brightness ceiling of the paper and paperboard in which liquid optical brightener is added to cooked starch or is cooked with starch and the resulting size composition is applied to the substrate at the size press, including any and all ranges and subranges therein The increase in brightness ceiling is more preferably at least about 5% to about 10% greater and most preferably at least about 5% to about 10% greater the brightness ceiling of the paper and paperboard in which liquid optical brightener is added to cooked starch or is cooked with starch and the resulting size composition is applied to the substrate at the size press.

In the preferred embodiments, the paper and paperboard exhibits a higher CIE Whiteness ceiling as compared to the paper and paperboard in which liquid optical brightener is added to cooked starch or is cooked with starch and the resulting size composition is applied to the substrate at the size press. The increase in CIE Whiteness ceiling is preferably at least about 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29% and 30% greater than the CIE Whiteness ceiling of the paper and paperboard in which liquid optical brightener is added to cooked starch or is cooked with starch and the resulting size composition is applied to the substrate at the size press, including any and all ranges and subranges therein The increase in brightness ceiling is more preferably at least about 5% to about 10% greater and most preferably at least about 5% to about 10% greater the CIE Whiteness ceiling of the paper and paperboard in which liquid optical brightener is added to cooked starch or is cooked with starch and the resulting size composition is applied to the substrate at the size press.

The differences in brightness ceiling increase with increases in the TAPPI Brightness of the substrate. It is preferred that the initial TAPPI brightness of the substrate prior to treatment in the process of this invention is least about 90, more preferably at least about 92 and most preferably from about 93. In the embodiments of choice, the initial TAPPI brightness of the substrate prior to treatment in the process of this invention is least about 94, 95 or 96.

The differences in CIE Whiteness ceiling increase with increases in the TAPPI Brightness of the substrate. It is preferred that the initial CIE Whiteness of the substrate prior to treatment in the process of this invention is at least about 85, more preferably at least about 130 and most preferably from about 100 to about 125. CIE Whiteness is preferably at least about 110, more preferably at least about 120.

The paper and paperboard manufactured in accordance with this invention can be used for conventional purposes. For example, the paper is useful as publication paper, packaging and the like.

The following specific examples are intended to illustrate the invention in detail and are not intended to be construed as a limitation thereon.

EXAMPLE 1

(A) Preparation of Size Press Compositions with Pre Cooked Addition of Optical Brightener ("OBA")

A series of surface starch applications were prepared using the following procedure. The starch was prepared in a lab Jet cooker. A certain amount of OBA was added to a starch slurry tank with a certain amount of dry ethylated starch. Water was added to make an ~18% total solids slurry (based on the total weight of composition) and the slurry was cooked at 299° F. in the jet cooker. The starch was diluted to the desired starch solids for this application of 13 to 16% depending on the tolerance of the system to size press treatment viscosity, and the desired pickup. The starch solution compositions and specifications are set for the in the following Table 1.

TABLE 1

Size Press Compositions with OBA - Pre Cooked Addition

| Size Press Composition | OBA Form | OBA Type | Ethylated Starch, (g) | Powdered OBA, (g) | Total Volume (L) | OBA Solids/ Total Solids (%) |
|---|---|---|---|---|---|---|
| [1]C-1 | | — | 1963 | — | 10 | — |
| 1 | Powdered | Hexa[2] | 1963 | 30.91 | 10 | 1.55 |
| 2 | Powdered | Hexa | 1963 | 61.81 | 10 | 3.05 |
| 3 | Powdered | Hexa | 2944 | 150.1 | 12 | 4.85 |
| 4 | Powdered | Tetra[3] | 1963 | 30.91 | 10 | 1.55 |
| 5 | Powdered | Tetra | 1963 | 61.81 | 10 | 3.05 |
| 6 | Powdered | Tetra | 1963 | 120.1 | 12 | 4.85 |

[1]"C" indicates that the composition is a comparison composition.
[2]"Hexa" is hexa sulfonate stilbene obtained from Daikaffil Chemical under the trade name Dikaphor BSU.
[3]"Tetra" is tetra sulfonate stilbene obtained from Aakash under the trade name SI 220.

(B) Preparation of Size Press Compositions with Post Cooked Addition of Optical Brightener A series surface starch applications was prepared using the following procedure. Starch was prepared slurring 3532 g of ethylated in 18 L of water and cooking the slurry at 299° F. in a jet cooker. The starch was diluted to the desired starch solids for this application of 13 to 16% depending on the tolerance of the system to size press treatment viscosity, and the desired pickup. The liquid OBA/starch solution compositions were prepared by adding commercially available liquid Hexa OBA to the cooked starch. The starch composition and specifications are set for the in the following Table 2.

TABLE 2

Size Press Compositions - Post Cooked Addition

| Starch Composition | OBA Type | Ethylated Starch, (g) | Liquid OBA, (g as received) | Liquid OBA, (g dry*) | Total Volume (L) | OBA Solids/ Total Solids (%) |
|---|---|---|---|---|---|---|
| C-2 | Hexa | 2,643.5 | 304.6 | 59.7 | 17.957 | 2.21 |
| C-3 | Hexa | 2,557.5 | 533.4 | 104.6 | 16.886 | 3.92 |
| C-4 | Hexa | 2,436.3 | 772.9 | 151.6 | 16.462 | 5.83 |
| C-5 | Hexa | 2,349.3 | 974.6 | 191.1 | 15.341 | 7.47 |

*g dry OBA was calculated by dividing the as received 5.1 based on HPLC and NMR analysis of relative OBA content of powdered and liquid products.

(C) Preparation of Laboratory Size Press Treated Paper

1. Substrate Preparation

The substrate used in this experiment was made on a paper machine from a furnish consisting of 60% softwood and 40% hardwood fibers and 12% clay filler under acid conditions. The basis weight of the substrate paper was about 116 g/m$^2$ and the Tappi Directional Brightness and CIE Whiteness were 77.7 and 68.9, respectively.

2. Size Press Treatment

To apply the surface starch formulation, a 12" wide roll of paper substrate was continuously fed between two rollers, and the starch formulation was pumped into the nip reservoir (puddle), the paper being fed through the nip reservoir at a prefixed speed. By controlling the formulation solids, nip pressure, and size press running speed, a total pickup weight of 3.8 to 4.5 g/m$^2$ was achieved.

The size press treated substrates and their specifications are set forth in the following Table 3.

TABLE 3

Size Press Treated Substrates

| Size Composition | OBA Form | OBA Type | Total Coverage, (gsm) | Starch, (gsm) | OBA, (gsm) |
|---|---|---|---|---|---|
| C-1 | — | — | 6.54 | 6.54 | — |
| 1 | Powder | Hexa | 6.44 | 6.34 | 0.10 |
| 2 | Powder | Hexa | 6.05 | 5.86 | 0.18 |
| 3 | Powder | Hexa | 6.68 | 6.35 | 0.32 |
| 4 | Powder | Tetra | 6.29 | 6.20 | 0.10 |
| 5 | Powder | Tetra | 5.95 | 5.77 | 0.18 |
| 6 | Powder | Tetra | 5.97 | 5.68 | 0.29 |
| C-2 | Liquid | Hexa | 6.50 | 6.36 | 0.14 |
| C-3 | Liquid | Hexa | 6.39 | 6.14 | 0.25 |
| C-4 | Liquid | Hexa | 6.99 | 6.59 | 0.41 |
| C-5 | Liquid | Hexa | 6.85 | 6.34 | 0.51 |

The Tappi Directional Brightness was measured using Tappi Test method T-452. The CIE Whiteness was measured using ISO-11475. The results of these evaluations are set forth in the following Table 4.

TABLE 4

Tappi Directional Brightness and CIE Whiteness

| Starch Composition | Tappi Directional Brightness | CIE Whiteness, D65 |
|---|---|---|
| C-1 | 77.7 | 68.94 |
| 1 | 81.4 | 101.68 |
| 2 | 82.8 | 112.80 |
| 3 | 83.4 | 117.90 |
| 4 | 81.9 | 104.21 |
| 5 | 82.8 | 111.63 |
| 6 | 82.7 | 112.43 |
| C-2 | 81.6 | 104.30 |
| C-3 | 82.5 | 111.78 |
| C-4 | 83.1 | 116.96 |
| C-5 | 83.2 | 119.68 |

EXAMPLE 2

(D) Preparation of Size Press Compositions with Pre Cooked Addition of OBAs

A series of surface starch applications were prepared using the following procedure. The starch was prepared in a batch cooker. A certain amount of powdered OBA was added to a starch slurry tank with a certain amount of dry oxidized starch. Water was added to make an ~16% total solids slurry and the slurry was cooked at 200° F. for twenty minutes. The starch was diluted to the desired starch solids for this application of 14 to 14.5% depending on the tolerance of the system to size press treatment viscosity, and the desired pickup. The starch solution compositions and specifications are set for the in the following Table 5.

TABLE 5

Size Press Compositions with Powdered OBA Pre Cooked Addition

| Size Press Composition | OBA Type | Oxidized Starch, (g) | Powdered OBA, (g) | Total Volume (L) | OBA Solids/Total Solids (%) |
|---|---|---|---|---|---|
| 7 | Hexa | 3178 | 122.4 | 19.1 | 3.71 |
| 8 | Hexa | 3178 | 203.7 | 19.6 | 6.02 |
| 9 | Hexa | 3178 | 285.1 | 20.0 | 8.23 |

(E) Preparation of Size Press Compositions with Post Cooked Addition of OBAs A series surface starch applications was prepared using the following procedure. The starch was prepared in a jet cooker. A certain amount of liquid OBA was added to a starch slurry tank with a certain amount of dry oxidized starch. Water was added to make an ~~18% total solids slurry and the slurry was cooked at 270° F. in the jet cooker. The starch was diluted to the desired starch solids for this application of approximately 14.5%. The liquid OBA/starch solution compositions were prepared by adding commercially available liquid Hexa OBA to the cooked starch. The starch composition and specifications are set forth in the Table 6.

TABLE 6

Size Press Compositions - Post Cooked Addition

| Starch Composition | OBA Type | Oxidized Starch, (g) | Liquid OBA, (g as received) | Liquid OBA, (g dry*) | Total Volume (L) | OBA Solids/ Total Solids (%) |
|---|---|---|---|---|---|---|
| C-6 | Hexa | 3178 | 317.8 | 62.31 | 21.4 | 1.89 |
| C-7 | Hexa | 3178 | 953.4 | 186.94 | 22.9 | 5.32 |
| C-8 | Hexa | 3178 | 1589 | 311.57 | 24.3 | 8.34 |

*g dry OBA was calculated by dividing the as received 5.1 based on HPLC and NMR analysis of relative OBA content of powdered and liquid products.

(F) Preparation of Pilot Size Press Treated Paper

1. Substrate Preparation

The substrate used in this experiment was made on a paper machine from a furnish consisting of approximately 80% softwood and 20% hardwood fibers with 20% calcium carbonate filler under alkaline conditions. The basis weight of the substrate paper was about 116 g/m$^2$ and the Tappi Directional Brightness and CIE Whiteness were 94.6 and 115.80, respectively.

2. Size Press Treatment

To apply the surface starch formulation, a 14" wide roll of paper substrate was continuously fed between two rollers, and the starch formulation was applied as a film onto the application rolls, the paper being fed through the rolls at a prefixed speed. By controlling the formulation solids, nip pressure, and size press running speed, a total pickup weight per side of 2.3 to 3.4 g/m$^2$ was achieved.

The size press treated substrates and their specifications are set forth in Table 7.

TABLE 7

| Size Press Treated Substrates | | | | | |
|---|---|---|---|---|---|
| Starch Composition | OBA Form | OBA Type | Total Coverage per Side, (gsm) | Starch per Side, (gsm) | OBA per Side, (gsm) |
| 7 | Powder | Hexa | 3.2 | 3.08 | 0.12 |
| 8 | Powder | Hexa | 3.3 | 3.10 | 0.20 |
| 9 | Powder | Hexa | 3.1 | 2.84 | 0.26 |
| C-6 | Liquid | Hexa | 3.4 | 3.34 | 0.06 |
| C-7 | Liquid | Hexa | 2.3 | 2.18 | 0.12 |
| C-8 | Liquid | Hexa | 3.4 | 3.12 | 0.28 |

The Tappi Directional Brightness was measured using Tappi Test method T-452. The CIE Whiteness was measured using ISO-11475. The results of these evaluations are set forth in the following Table 8.

TABLE 8

| Tappi Directional Brightness and CIE Whiteness | | |
|---|---|---|
| Starch Composition | Tappi Directional Brightness | CIE Whiteness, D65 |
| 7 | 97.4 | 141.74 |
| 8 | 97.9 | 144.69 |
| 9 | 98.2 | 146.41 |
| C-6 | 96.3 | 134.51 |
| C-7 | 97.2 | 140.47 |
| C-8 | 97.6 | 143.16 |

The invention claimed is:

1. A method of manufacturing paper and paperboard products comprising:

forming a composition comprising water, uncooked starch and powdered optical brightener;

cooking the composition to form a cooked composition comprising cooked starch and powdered optic brightener;

applying the cooked composition to at least one surface of a paper or paperboard substrate at the size press in a paper or paperboard manufacturing process to form a sized paper or paperboard substrate; and drying the sized paper or paperboard substrate to form a dried sized paper or paperboard substrate.

2. The process of claim 1 wherein the uncooked starch is selected from the group consisting ethylated starch, oxidized starch, pearl starch and a combination of two or more thereof.

3. The process of claim 1 wherein the powdered optical brightener is in amount of from about 2% to about 10% based on the total weight of the composition.

4. The process of claim 1 wherein the step of cooking the composition is carried out at a temperature equal to or greater than from about 115° F.

5. The process of claim 1 wherein the step of cooking the composition is carried out at a temperature up to and including about 299° F.

6. The process of claim 1 wherein the step of cooking the composition is carried out in the presence of enzyme.

7. The process of claim 1 wherein the step of cooking the composition is carried out in a batch process.

8. The process of claim 1 wherein the step of cooking the composition is carried out in a jet cooking process.

9. The process of claim 1 wherein the dried sized paper or paperboard substrate exhibits a brightness ceiling of about 2% to about 30% greater than the brightness ceiling of the paper or paperboard in which uncooked liquid optical brightener is added to a cooked starch.

10. The process of claim 1 wherein the dried sized paper or paperboard substrate exhibits a CIE Whiteness ceiling of about 2% to about 30% greater than the whiteness ceiling of the paper or paperboard in which uncooked liquid optical brightener is added to a cooked starch.

11. The process of claim 1 wherein the powdered optical brightener is hexa sulfonate stilbene based optical brightening agent.

12. The process of claim 1 wherein the powdered optical brightener is tetra sulfonate based optical brightening agent.

13. A process of manufacturing paper and paperboard products comprising:

forming a composition comprising water, uncooked starch and powdered optical brightener;

cooking the composition at a temperature up to and including 299° F. to form a cooked sizing composition comprising cooked starch and powdered optical brightener;

applying the cooked composition to at least one surface of a paper or paperboard substrate at the size press in a paper or paperboard manufacturing process to form a sized paper or paperboard substrate; and drying the sized paper or paperboard substrate to form a dried sized paper or paperboard substrate.

* * * * *